US005092378A

United States Patent [19]

Dunham

[11] Patent Number: 5,092,378

[45] Date of Patent: Mar. 3, 1992

[54] COMMUNION CUP FILLER

[76] Inventor: Sherman D. Dunham, RT1, 48W323 Keslinger Rd., Maple Park, Ill. 60151

[21] Appl. No.: 598,066

[22] Filed: Oct. 16, 1990

[51] Int. Cl.[5] ..... B65B 3/06

[52] U.S. Cl. ..... 141/237; 141/239; 141/236

[58] Field of Search ..... 141/234, 236-240, 141/242-247; 222/164, 166, 431, 454, 485, 506

[56] References Cited

U.S. PATENT DOCUMENTS

| | | | |
|---|---|---|---|
| 298,060 | 5/1884 | Blair | 141/242 |
| 678,699 | 7/1901 | Thomas | 141/239 |
| 858,051 | 6/1907 | Allen | 141/242 |
| 1,092,565 | 4/1914 | Dix | 141/239 |
| 1,416,126 | 5/1922 | Rainey | 141/244 |
| 1,528,978 | 3/1925 | McClellan | 141/244 |
| 1,778,888 | 10/1930 | Davis | 141/239 x |
| 1,955,441 | 4/1934 | Schnaier | 141/239 X |
| 1,987,580 | 1/1935 | Schneider | 141/244 X |
| 2,024,130 | 12/1935 | Kronbach | 141/239 |
| 2,586,557 | 2/1952 | Newbold | 141/239 X |
| 2,800,930 | 7/1957 | Blaru | 141/242 X |
| 2,857,669 | 10/1958 | Hain | 222/166 x |
| 2,872,953 | 2/1959 | Duncan | 222/485 X |
| 2,939,495 | 6/1960 | Thorpe | 222/166 X |
| 3,196,909 | 7/1965 | Monk | 141/237 |
| 3,304,965 | 2/1967 | Tate | 141/238 |
| 3,664,387 | 5/1972 | Cates, Jr. | 141/238 |
| 4,015,646 | 4/1977 | Borrow | 141/239 |

*Primary Examiner*—Henry J. Recla
*Assistant Examiner*—Casey Jacyna

[57] ABSTRACT

The communion cup filler is a device that fills a full tray of communion cups all simultaneously in a matter of several seconds. It is made in one piece by injection molding. The rectangular central panel contains a number of conduits each leading to a drain hole. The top of the central panel supports retaining walls on all 4 sides. The central panel is angled to cause the base to tilt to the rear in an at rest mode. The inside of the two front legs, each contain a slide rail to allow a communion tray to slide down the rails. A stop barrier is located on the bottom of the central panel which stops the communion tray at a precise location relative to the holes in the central panel. A hollow nipple protrudes from each hole from the bottom of the central panel.

The ribs on the top of the central panel run from each hole toward the rear containment wall but stop short of joining it. This leaves a reservoir area where a predetermined amount of liquid is poured. With the reservoir area and end of ribs open, the liquid seks its own level and meters out an equal amount to each conduit. A tray of communion cups is inserted down the rails to the stop barrier. The tray is rotated until a predetermined mark on the tray aligns with an arrow on the front outside containment wall. Lifting the rear end higher than the front end allows the liquid to flow down each conduit through each hole in the central panel, down each associated nipple and into each communion cup.

1 Claim, 1 Drawing Sheet

COMMUNION CUP FILLER

BACKGROUND—FIELD OF INVENTION

This invention relates to filling a full tray of communion cups in a matter of seconds, with liquid.

BACKGROUND—DESCRIPTION OF PRIOR ART

Many churches serve communion on a weekly or monthly basis. A number of these churches utilize a communion tray loaded with a quantity of 40 or more small individual communion cups. In order to fill these cups, the primary method has been to hand pour liquid from a container into each individual cup—one at a time—a very time consuming and tiring process. Several attempts have been made to devise a way to fill the whole tray of cups quickly. The methods tried have not been very successful. One example is U.S. Pat. No. 3,196,909 3/21/63 issued to Ellis Monk, Des Moines, Iowa. This device required assembly and disassembly each time it was used. If instructions were not followed perfectly, the unit would malfunction.

Another major problem concerned the size of the drain holes. Since they had to be so small, the holes clogged easily with sediment causing some cups to remain empty.

Another problem was cleaning the device. Cleaning required the disassembly of 4 parts. If the cleaning process was not thorough, sediment would remain in the small drain holes and cause a malfunction when it was used again. In addition, if the re-assembly was not completed perfectly, the unit would malfunction with the next usage.

Time required to fill all cups ran to 15 seconds. Instructions to operate, assemble and disasemble, and clean the device were often lost. Therefore those who needed to use it were unable to do so. Because of customer problems, the device was withdrawn from the market.

OBJECTS AND ADVANTAGES

The present invention has been designed to eliminate the above described problems and fullfill the following objectives.

a.) To provide a fast and efficient method of filling a complete tray of cups simultaneously.

b.) To provide a device that will fill all the cups quickly.

c.) To provide a device that is easy to use with little instruction.

d.) To provide a means whereby the instructions are always accessable and never lost.

e.) To provide a device that is easy to clean.

f.) To provide a device with no moving parts to wear out.

g.) To provide a device that can not malfunction.

h.) To provide a device that can not clog due to poor cleaning.

i.) To provide a device that does not require either assembly or disassembly to clean and use.

j.) To provide a device that fills each individual cup accurately to the same amount.

k.) To provide a device that is clean to use.

l.) To provide a device that is durable and break resistant.

m.) To provide a device that is manufactured in one piece requiring no assembly.

n.) To provide a device that will not overflow causing a mess.

Still further advantages will become apparent from the consideration of the ensuing description and drawings.

REFERENCE NUMBERS IN DRAWINGS

| |
|---|
| 10 CENTRAL PANEL |
| 12 BACK CONTAINMENT WALL |
| 14 LEFT SIDE CONTAINMENT WALL |
| 16 RIGHT SIDE CONTAINMENT WALL |
| 18 FRONT CONTAINMENT WALL |
| 20 RIGHT SLIDE RAIL |
| 22 LEFT SLIDE RAIL |
| 24 CONDUIT |
| 26 RIB |
| 28 RESERVOIR |
| 30 DRAIN HOLE |
| 32 ALIGNMENT ARROW |
| 34 OPERATING INSTRUCTIONS |
| 36 FILL LEVEL CHART |
| 38 NIPPLE |
| 40 STOP BARRIER |
| 42 LEFT REAR LEG |
| 44 RIGHT SIDE REAR LEG |
| 46 LIQUID |
| 48 COMMUNION CUP TRAY |
| 50 RIGHT FRONT LEG |
| 52 LEFT FRONT LEG |
| 54 "POUR HERE" INSTRUCTIONS |
| 56 MARKING INSERT INSTRUCTIONS |

DESCRIPTION OF THE PREFERRED EMBODIMENT

Figure 1:
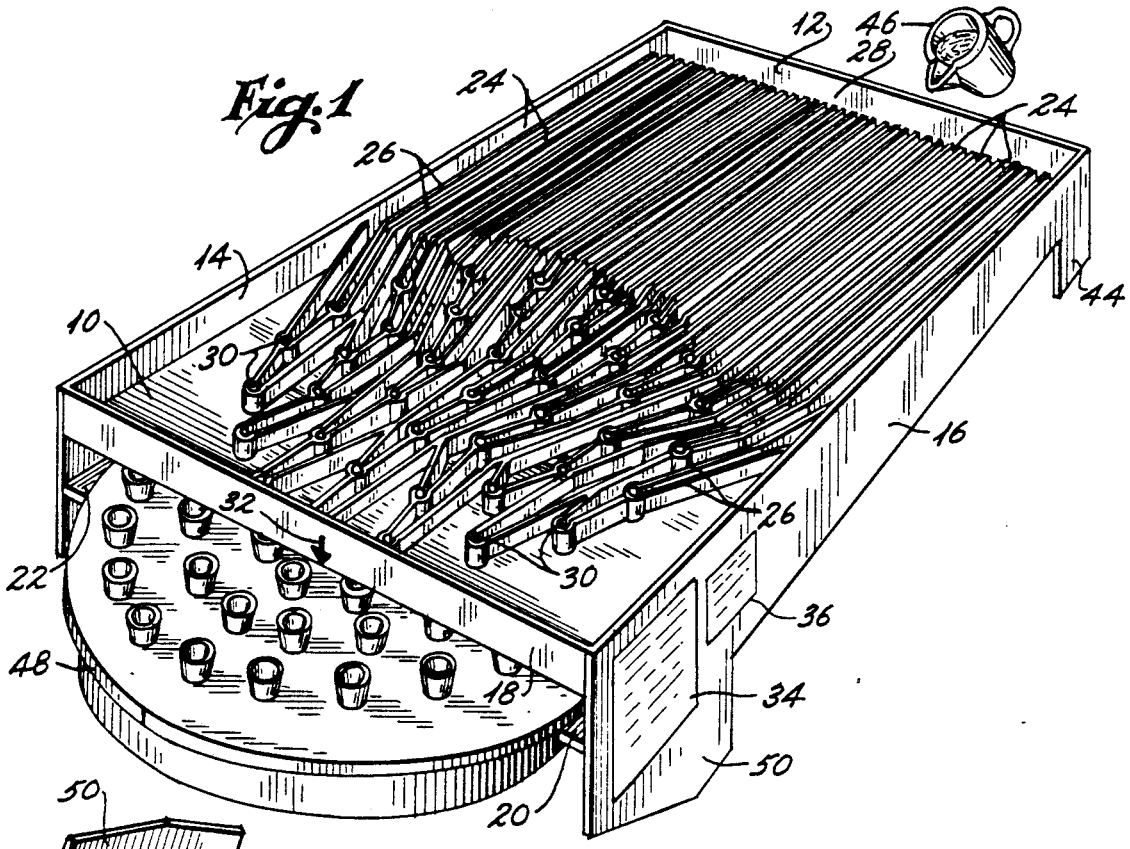
FIG. 1—Shows the filler from the top-right-front view.

FIG. 1 shows a perspective view of the communion cup filler from the top-front-right side. The communion cup filler is made in one complete piece using an injection molding process. The material used is one such as polypropylene or abs. The central panel 10—rectangular and flat, contains a number of ribs 26 forming individual conduits 24 which lead to individual drain holes 30. An open area at the back end forms a reservoir 28 used to store liquid which is contained by the back containment wall 12, the right side containment wall 16, the left side containment wall 14, and front containment wall 18. Each containment wall rises vertically from the central panel 10 upward. The right side containment wall 16 and left side containment wall 14 also extend vertically downward to form legs 42, 44 at the backside of the central panel 10 and legs 50, 52 at the front end of the central panel 10. The drain holes 30 run longitudinally through the thin central panel 10. The rear left leg 44 and rear right leg 42 are shorter than the right front leg 50 and left front leg 52—thereby tilting the communion cup filler at an angle toward the rear when at rest.

Operating instructions 34 and fill level chart 36 are imprinted on the outside of the right front leg. An arrow 32 is imprinted on the outside of the front containment wall. Communion tray 48 is inserted on right side rail 20 and left side rail 22 in order to slide down to barrier stop 40. The front legs 50, 52 are beveled in order to limit the amount of tilting during the filling process. Liquid 46 is being poured along the backend of the communion cup filler into the reservoir 28.

Figure 2:
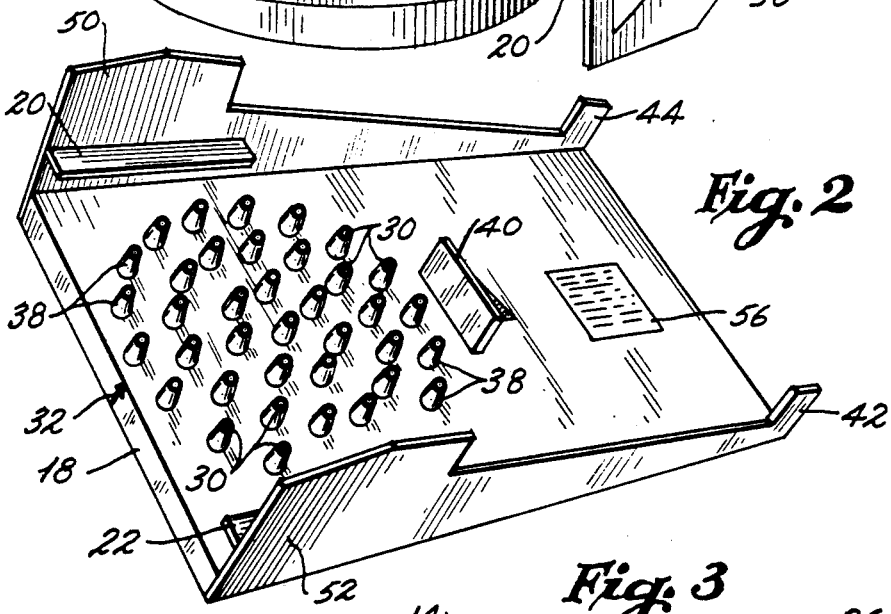
FIG. 2—Shows the filler from the bottom side facing upwards.

FIG. 2 shows a perspective of the communion cup filler from the bottom-front-left side. The right side rail 20 is formed on the inside of right front leg and runs length wise toward the back end of the communion cup filler. Left side rail 22 is formed on the inside right front leg and runs lengthwise from the front toward the back end of the communion cup filler. Hollow nipples 38 are formed vertically downward from the bottom of the central panel 10. Marking instructions 56 are imprinted on the bottom of the central panel.

Figure 3:
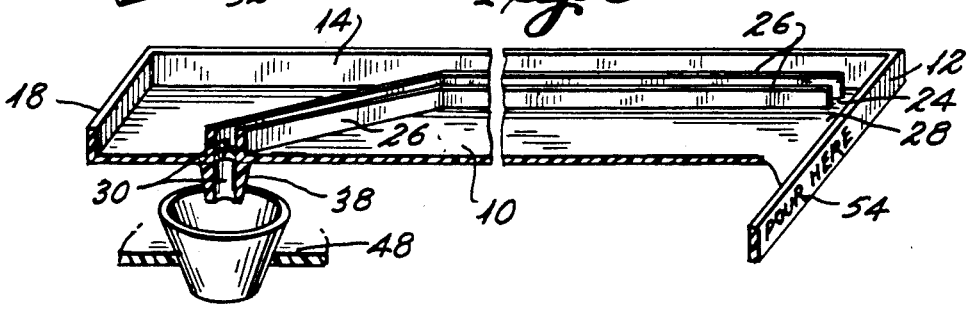
FIG. 3— Shows an individual conduit leading to a drain hole that fills a typical cup.

FIG. 3 shows a typical conduit 24 formed by two ribs 26 that lead to a typical drain hole 30 and nipple 38, and the backend of the communion cup filler with "pour here" 54 instructions imprinted on the outside of the back containment wall 12.

OPERATION OF INVENTION

To operate—the communion cup filler is set on a level surface such as a cabinet counter top. In the "at rest" position, the back end sits lower than the front end. A communion tray of empty communion cups is inserted down the left slide rail 22 and right slide rail 20 until it stops at the stop barrier 40. The communion tray is then rotated until a predetermined mark on the communion tray, lines up with the arrow 32 on the front containment wall. A predetermined amount of liquid 46 is poured into the reservoir 28. Since the ribs 26 end before reaching the back containment wall, the liquid is allowed to flow freely into all conduits 24 since liquid will seek its own level. This allows the same amount of liquid to be stored in each conduit 24. The containment walls keep the liquid contained in the reservoir and conduits. The operator raises the backend of the communion cup filler which allows the fluid to flow down each conduit 24 to each drain hole 30 and down through each hollow nipple 38. This allows the liquid to drain smoothly and accurately with no splashing, into each communion cup directly under each drain hole. The front legs 50, 52 having a bevel, limits the angle of tilting during the filling process—thus preventing the overflow of the ribs. When the liquid is totally dispensed, the backend of the communion cup filler is returned to the "at rest" position—setting on its rear legs. The communion tray, now full, is removed.

Accordingly, the reader will see that the communion cup filler meets the need of filling a multiple number of communion cups quickly, saving the user much time and effort. In addition, this unique communion cup filler:

- Allows for cleaning without having to disassemble and reassemble the device—thus saving time and effort and preventing any errors in re-assembly that could cause a malfunction in the next usage.
- Allows for easy, fast and thorough cleaning—a must for any device dispensing liquid to be injested.
- Made in one solid piece with no moving parts to wear out and replace, and no assembly or disassembly required.
- Made with all instructions for its operation, etched in the communion cup filler—thus eliminating the problem of lost instruction sheets.
- Utilizing the properties of liquid seeking its own level to accurately and quickly meter out and store in each individual conduit, equal amounts of liquid to flow to each communion cup.
- Containment walls on all four sides of the central panel to prevent any liquid from accidently exiting any other way than through the conduits, holes and nipples—thus keeping the work area clean and free from liquid spills.
- Made very simple to use with etched-in clear and easy to follow instructions.
- Made from a material such as polypropylene or abs that is very durable and break resistant in case of an accidental drop, easy to clean and store.
- Capable of filling a tray of communion cups all at the same time in one swift motion in a time of less than 5 seconds.
- Front legs made with a bevel to limit the raising position preventing overflow of the ribs.

Although the description above contains a number of specifics, these should not be construed as limiting the scope of this invention, but as merely providing illustrations of some of the present embodiments of this invention. The scope of this invention should be determined by the appended claims and their legal equivalents rather than by the examples given.

I claim:

1. A device for metering and dispensing liquid to a quantity of communion cups positioned in a tray and comprising:

a.) a central panel having a top side, a bottom side and connecting sidewalls, an end wall and a front wall extending upwards from said panel, b.) said side walls extending downwards below said central panel to form legs for said device, c.) said central panel slopes downward from an upper portion at said front wall to a lower portion at said end wall, wherein said end wall and said sidewalls define a reservoir to store liquid, d.) on said top side of said central panel is a series of elongated ribs which are spaced apart to form conduits, e.) said adjacent conduits share a common said rib, f.) the inner ends of said ribs terminate next to said reservoir and thus short of said end wall, g.) the outer end of each of said conduit rib pairs is closed by an outer end wall, h.) inward from each of said conduit outer end walls is an opening in said central panel, i.) positioned about each of said openings and extending downward from said bottom side of said central panel is a nipple, j.) said openings and respective said nipples are positioned in an array and are adapted to align vertically with communion cups carried on one side of a standard communion cup tray, k.) slide rails are positioned along the insides of said legs and are adapted to accept and position a said standard communion cup tray, l.) a stop barrier extends downward from the bottom side of said central panel and is adapted to form a stop method in positioning said standard communion cup tray, m.) during use, liquid is poured into said reservoir of the said filling device, flowing equally into said conduits, n.) said reservoir end of said filling device is then raised, o.) stops on the said legs of said filling device limit this raising, p.) liquid flows down each of said conduit through said openings and said nipples and into said cups in the said standard communion cup tray located there below.

* * * * *